US012570340B2

(12) United States Patent
Xing et al.

(10) Patent No.: US 12,570,340 B2
(45) Date of Patent: Mar. 10, 2026

(54) RAIL TRANSIT SIGNAL SYSTEM WITH MULTI-NETWORK INTEGRATION

(71) Applicant: CASCO SIGNAL LTD., Shanghai (CN)

(72) Inventors: Yanyang Xing, Shanghai (CN); Xiaoyong Wang, Shanghai (CN); Haigui Xu, Shanghai (CN); Huaxiang Liu, Shanghai (CN); Liang Pan, Shanghai (CN); Ye Xu, Shanghai (CN); Yiran Lu, Shanghai (CN); Wei Feng, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 608 days.

(21) Appl. No.: 18/005,475

(22) PCT Filed: Sep. 22, 2021

(86) PCT No.: PCT/CN2021/119551
§ 371 (c)(1),
(2) Date: Jan. 13, 2023

(87) PCT Pub. No.: WO2022/198946
PCT Pub. Date: Sep. 29, 2022

(65) Prior Publication Data

US 2023/0278610 A1 Sep. 7, 2023

(30) Foreign Application Priority Data

Mar. 25, 2021 (CN) ..... 202110319676.7

(51) Int. Cl.
*B61L 27/30* (2022.01)
*B61L 19/06* (2006.01)
*B61L 27/70* (2022.01)

(52) U.S. Cl.
CPC ..... *B61L 27/30* (2022.01); *B61L 19/06* (2013.01); *B61L 27/70* (2022.01); *B61L 2201/00* (2013.01); *B61L 2205/02* (2013.01)

(58) Field of Classification Search
CPC ..... B61L 27/30; B61L 27/70; B61L 19/06; B61L 2201/00; B61L 2205/02
See application file for complete search history.

(56) References Cited

U.S. PATENT DOCUMENTS 5,398,894 A * 3/1995 Pascoe ..... B61L 21/10 246/62
10,778,363 B2 * 9/2020 Carlson ..... B61L 3/125
(Continued)

FOREIGN PATENT DOCUMENTS

CN 106741013 A * 5/2017 ..... B61L 27/30
CN 106915367 A 7/2017
CN 107235052 A * 10/2017 ..... B61L 27/10
CN 109677449 A * 4/2019 ..... B61L 15/00
(Continued)

OTHER PUBLICATIONS

International Search Report (with English translation) and Written Opinion issued in PCT/CN2021/119551, dated Nov. 29, 2021, 8 pages provided.

*Primary Examiner* — Jason C Smith
(74) *Attorney, Agent, or Firm* — HSML P.C.

(57) ABSTRACT

The present disclosure relates to a rail transit signal system with multi-network integration, including: a wayside train control subsystem for simultaneously supporting mixed tracking operation of a China train control system (CTCS)-based national railway train and a communication based train control (CBTC)-based urban rail transit train; a compatible carborne subsystem for realizing cross-line operation of a national railway line network, an intercity railway network, a municipal railway network, and an urban rail transit network; a networked intelligent dispatching subsystem for realizing intelligent dispatching management of rail
(Continued)

transit line networks and cooperation of line network operation plans between different rail transit line networks; an interlocking subsystem being respectively communicatively connected to and interacting with the wayside train control subsystem, the compatible carborne subsystem, and the networked intelligent dispatching subsystem; and a wireless train-ground communication subsystem for simultaneously providing communication for the national railway train and the urban rail transit train. Compared to the prior art, the present disclosure has the advantages of interconnection and interworking, deep integration, etc.

7 Claims, 4 Drawing Sheets

(56) References Cited

U.S. PATENT DOCUMENTS

| | | | | |
|---|---|---|---|---|
| 12,296,877 | B2 * | 5/2025 | Hu | B61L 27/70 |
| 2023/0278610 | A1 * | 9/2023 | Xing | B61L 19/06<br>246/4 |
| 2023/0322282 | A1 * | 10/2023 | Feng | B61L 3/02<br>701/19 |

FOREIGN PATENT DOCUMENTS

| | | | | |
|---|---|---|---|---|
| CN | 109664923 | B * | 3/2021 | B61L 15/0027 |
| CN | 113954931 | A * | 1/2022 | B61L 25/025 |
| CN | 114179871 | A * | 3/2022 | B61L 27/00 |
| EP | 4155166 | A1 * | 3/2023 | B61L 27/04 |

* cited by examiner

RAIL TRANSIT SIGNAL SYSTEM WITH MULTI-NETWORK INTEGRATION

FIELD OF TECHNOLOGY

The present disclosure relates to a rail transit signal system, in particular to a rail transit signal system with multi-network integration.

BACKGROUND

At present, there are four typical rail transit networks in China, which are a national railway network, an intercity railway network, a municipal railway network, and an urban rail transit network, respectively. The national railway network connects important central cities, with a target speed ranging from 250 km/h to 350 km/h, a line operation speed of 300 km/h, and an average station spacing of 50 km or above: intercity rail transit is a public rail transit line in a regional urban agglomeration, with a target speed ranging from 160 km/h to 200 km/h, a line length of about 150 km, and an average station spacing of about 10 km: a municipal rail transit line along with operation characteristics is somewhere between the intercity rail transit and urban rail transit, with a target speed ranging from 120 km/h to 160 km/h and a line length of about 80 km; and the urban rail transit realizes an urban public rail transit line, with a target speed ranging from 80 km/h to 100 km/h, a line length of about 30 km, and an average station spacing of about 1.2 km.

Due to different operation requirements such as the target speed, the line length, the station spacing, and the operation interval, different train control systems are used in different railway networks. A China train control system (CTCS), that has the high average travel speed and may meet the requirement of 5-minute operation interval, is mostly used in the national railway network: a wireless communication based train control (CBTC) system, that has the low average travel speed and may meet the requirement of 2-minute operation interval, is mostly used in the urban rail transit; and however, the operation requirement of the intercity railway network and the municipal railway is somewhere between the national railway and the urban rail transit, some lines adopt a national railway train control mode or an urban rail train control mode according to different investment subjects and operation requirements, and two train control systems differ greatly, resulting in that national railway system trains cannot operate on urban rail system lines and urban rail system trains cannot operate on national railway system lines. As a result, the line networks become independent of each other, which cannot realize sharing of line resources and train resources, and increases the time cost of passenger travel.

With the acceleration of urbanization process, cities and suburbs, and cities and cities are more and more closely integrated. How to achieve integrated transportation of multi-network integration and interconnection and interworking has become a technical problem to be solved.

SUMMARY

To overcome the above defects existing in the prior art, an objective of the present disclosure is to provide a rail transit signal system with multi-network integration.

The objective of the present disclosure may be achieved through the following technical solution:

According to one aspect of the present disclosure, a rail transit signal system with multi-network integration is provided, including:

a wayside train control subsystem for simultaneously supporting mixed tracking operation of a China train control system (CTCS)-based national railway train and a communication based train control (CBTC)-based urban rail transit train:

a compatible carborne subsystem for realizing cross-line operation of a national railway line network, an intercity railway network, a municipal railway network, and an urban rail transit network:

a networked intelligent dispatching subsystem for realizing intelligent dispatching management of rail transit line networks and cooperation of line network operation plans between different rail transit line networks:

an interlocking subsystem being respectively communicatively connected to and interacting with the wayside train control subsystem, the compatible carborne subsystem, and the networked intelligent dispatching subsystem; and a wireless train-ground communication subsystem for simultaneously providing communication for the national railway train and the urban rail transit train.

As a preferred technical solution, the wayside train control subsystem includes a zone controller, a radio block center, a train control center, a temporary speed restriction server, a track circuit, and a beacon:

the zone controller is respectively connected to the compatible carborne subsystem, the networked intelligent dispatching subsystem, and the interlocking subsystem: the radio block center is respectively connected to the temporary speed restriction server, the compatible carborne subsystem, and the interlocking subsystem: the train control center is respectively connected to the track circuit, the beacon, the temporary speed restriction server, the networked intelligent dispatching subsystem, and the interlocking subsystem: the temporary speed restriction server, the track circuit, and the beacon are respectively connected to the compatible carborne subsystem; and the track circuit is connected to the interlocking subsystem.

As a preferred technical solution, the wayside train control subsystem further includes a wayside switch machine and a signal connected to the train control center, and the train control center is configured to generate a code order of the track circuit and a movement authority according to collected equipment status information of the wayside switch machine, the signal, and the track circuit, and location information of the train, to control mixed operation of the trains of different systems and to realize safety interval protection between the trains.

As a preferred technical solution, the compatible carborne subsystem adopts a high-performance, secure and universal platform.

As a preferred technical solution, in the national railway system line network, the compatible carborne subsystem is provided with a radio block center interface with national railway train control and is configured to control the train operation according to the movement authority provided by the radio block center and to control the train operation according to track circuit information and beacon information by reading the code order of the track circuit and the beacon information when the radio block center is unavailable.

As a preferred technical solution, in the urban rail system line network, the compatible carborne subsystem is provided with an interface with the zone controller and is configured to control the train operation according to the movement authority provided by the zone controller.

As a preferred technical solution, the networked intelligent dispatching subsystem is configured to dynamically display a line equipment status and a train operation status in real time, to provide system operation modes of different levels, to manage operation missions of the trains operating in the line networks according to a timetable, to cooperate cross-line network operation train plans, to record operation data to generate a statistical report, and to provide play back and training functions.

As a preferred technical solution, the interlocking subsystem is configured to control the switch machine and the signal according to a route command, to collect statuses of a platform door, an emergency stop button, and the track circuit, and to realize secure locking and unlocking of a route; and meanwhile, the interlocking subsystem is provided with secure interfaces with the zone controller, the wayside train control subsystem, and the compatible carborne subsystem.

As a preferred technical solution, the wireless train-ground communication subsystem adopts an integrated global system for mobile communications-railway (GSM-R) and long term evolution-machine (LTE-M) communication module, and provides GSM-R communication for the national railway train and LTE-M communication for the urban rail transit train.

As a preferred technical solution, the wireless train-ground communication subsystem simultaneously reserves interfaces for LTE to comprehensively bear an LTE-M service and a long term evolution-railway (LTE-R) service.

Compared to the prior art, the present disclosure has the following advantages:

1) The present disclosure may simultaneously operate in the national railway system line network and the urban rail system line network through a set of universal compatible carborne subsystem, without installing multiple sets of carborne equipment of different systems on the same train, thereby saving construction and maintenance costs, and avoiding complex design of switching between different carborne equipment.
2) The present disclosure may realize cross-line network operation of the same train and operation of the trains from other different system line networks, in the line network equipped with the signal system in this solution, so as to meet the requirement of "arrival and departure" bidirectional interconnection and interworking operation.
3) The interlocking subsystem in the present disclosure integrates national railway interlocking and urban rail interlocking software and engineering data, and simultaneously meets the requirements of national railway interlocking rules and urban rail interlocking rules. Through data of a set of hardware and a set of software, the requirements of the system with multi-system integration may be met, thereby avoiding repeated setting of multiple sets of interlocking, and simplifying design of the internal interfaces of the system.
4) The dispatching management subsystem in the present disclosure meets the requirement of cross-line network operation diagram cooperation, simultaneously meets the requirements of high-density and mass transit operation, manages the fixed number of national railway trains and the urban rail transit trains that are flexible for arrival and departure by labeling different train attributes, and realizes the compatibility of different dispatching strategies for the mass transit operation of the fixed number of national railway trains and the urban rail transit trains.
5) In the present disclosure, GSM-R and LTE-M are tightly coupled to each other in design, and the GSM-R is introduced through an LTE-M base station to establish a multi-mode base station for realizing that a set of communication subsystem simultaneously meets the requirements of a national railway service and a urban rail service; and value-added services are provided for national railway operation through LTE comprehensive bearing.
6) In the solution of the integrated rail transit signal system with multi-network integration in the present disclosure, the internal interfaces are standardized, and the system may be flexibly configured as a national railway system solution, an urban rail system solution, or a multi-network integration solution according to the actual operation requirement of the line network.

DETAILED DESCRIPTION OF THE EMBODIMENTS

Figure 1:
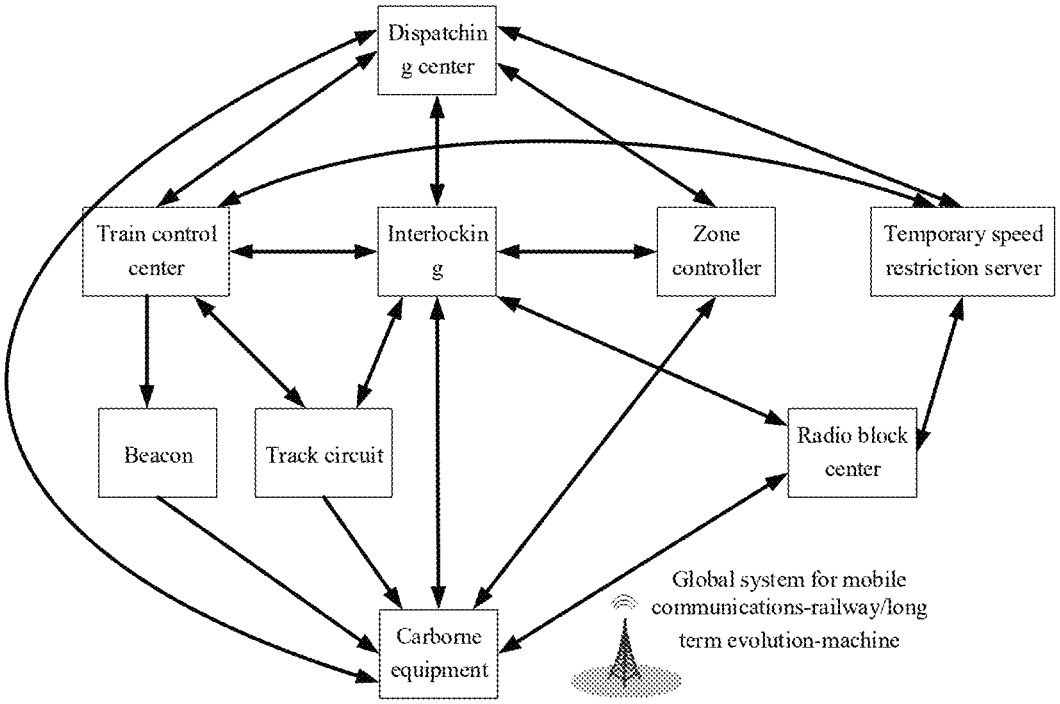
FIG. 1 is a schematic structural diagram of a rail transit signal system with multi-system integration according to the present disclosure.

The technical solutions in the embodiments of the present invention will be clearly and completely described below with reference to the accompanying drawings in the embodiments of the present disclosure. Apparently, the described embodiments are part rather than all of the embodiments of the present disclosure. All other embodiments obtained by those of ordinary skill in the art based on the embodiments of the present disclosure without creative efforts should fall within the scope of protection of the present disclosure.

According to a rail transit signal system based on multi-network integration in the present disclosure, the system ensures that cross-line network interconnection and interworking operation of a China train control system (CTCS)-based national railway train and a communication based train control (CBTC)-based urban rail transit train may be realized. In the solution, the system includes: wayside equipment integrated as a set of wayside train control subsystem for simultaneously supporting mixed tracking operation of the CTCS-based national railway train and the CBTC-based urban rail transit train: a compatible carborne subsystem equipped with a set of carborne equipment for realizing cross-line operation of a national railway line network, an intercity railway network, a municipal railway network, and an urban rail transit network: a set of networked intelligent dispatching subsystem used for a center and configured to realize intelligent dispatching management of rail transit line networks and cooperation of line network operation plans between different rail transit line networks; and a wireless train-ground communication subsystem adopting a global system for mobile communications-railway (GSM-R) and long term evolution-machine (LTE-M) tight coupling solution. A set of wireless train-ground communication subsystem integrated simultaneously provides GSM-R communication for the national railway train and LTE-M communication for the urban rail transit train, while the compatible carborne subsystem may support GSM-R and LTE-M communication modes. Compared to an existing rail transit signal system solution, the present disclosure has the advantages of interconnection and interworking, deep integration of integrated carborne and wayside systems, etc., and may meet the requirement of "arrival and departure" interconnection and interworking operation of the rail transit signal system.

The subsystems are specifically as follows:

1) The dispatching management subsystem is arranged in the dispatching center and is configured to dynamically display a line equipment status and a train operation status in real time, to provide system operation modes of different levels, to manage operation missions of the trains operating in the line networks according to a timetable, to cooperate cross-line network operation train plans, to record operation data to generate a statistical report, and to provide play back and training functions.
2) The wayside train control subsystem includes a zone controller, a radio block center, a train control center, a temporary speed restriction server, a track circuit, and a beacon, and is configured to collect statuses of basic equipment such as a wayside switch machine, a signal, and the track circuit, and a location report of the train, to generate a code order of the track circuit and a movement authority, to control mixed operation of trains of different systems and to realize safety interval protection between the trains.
3) The interlocking subsystem is configured to control the switch machine and the signal according to a route command, to collect statuses of a platform door, an emergency stop button, and the track circuit, and to realize secure locking and unlocking of a route. The interlocking subsystem may achieve secure interfaces with the zone controller, the wayside train control subsystem, and the carborne subsystem.
4) The carborne subsystem adopts a high-performance, secure and universal platform, and may be compatible with the CTCS-based national railway train and the CBTC-based urban rail transit train. In the national railway system line network, this carborne subsystem may achieve a radio block center interface with national railway train control and is configured to control the train operation according to the movement authority provided by the radio block center or control the train operation according to track circuit information and beacon information by reading a code order of the track circuit and the beacon information when the radio block center is unavailable. In the urban rail system line network, this carborne subsystem may achieve an interface with the zone controller and is configured to control the train operation according to the movement authorization provided by the zone controller.
5) The wireless train-ground communication subsystem adopts an integrated GSM-R and LTE-M communication solution, and a soft switch core network may simultaneously support GSM-R and LTE-M services. In view of the development of national railway wireless communication technology, this solution simultaneously reserves interfaces for LTE to comprehensively bear the LTE-M service and the LTE-R service.

Specific Embodiments

FIG. 1 is a schematic structural diagram of a rail transit signal system with multi-system integration. The universal interlocking subsystem, the compatible carborne hardware security platform, and the multi-network cooperative dispatching management subsystem adapted for multi-network integration are deployed. Through deep integration of the national railway signal system and the urban rail signal system, the integrated rail transit signal system adapted for multi-network integration is innovatively designed.

Figure 2:
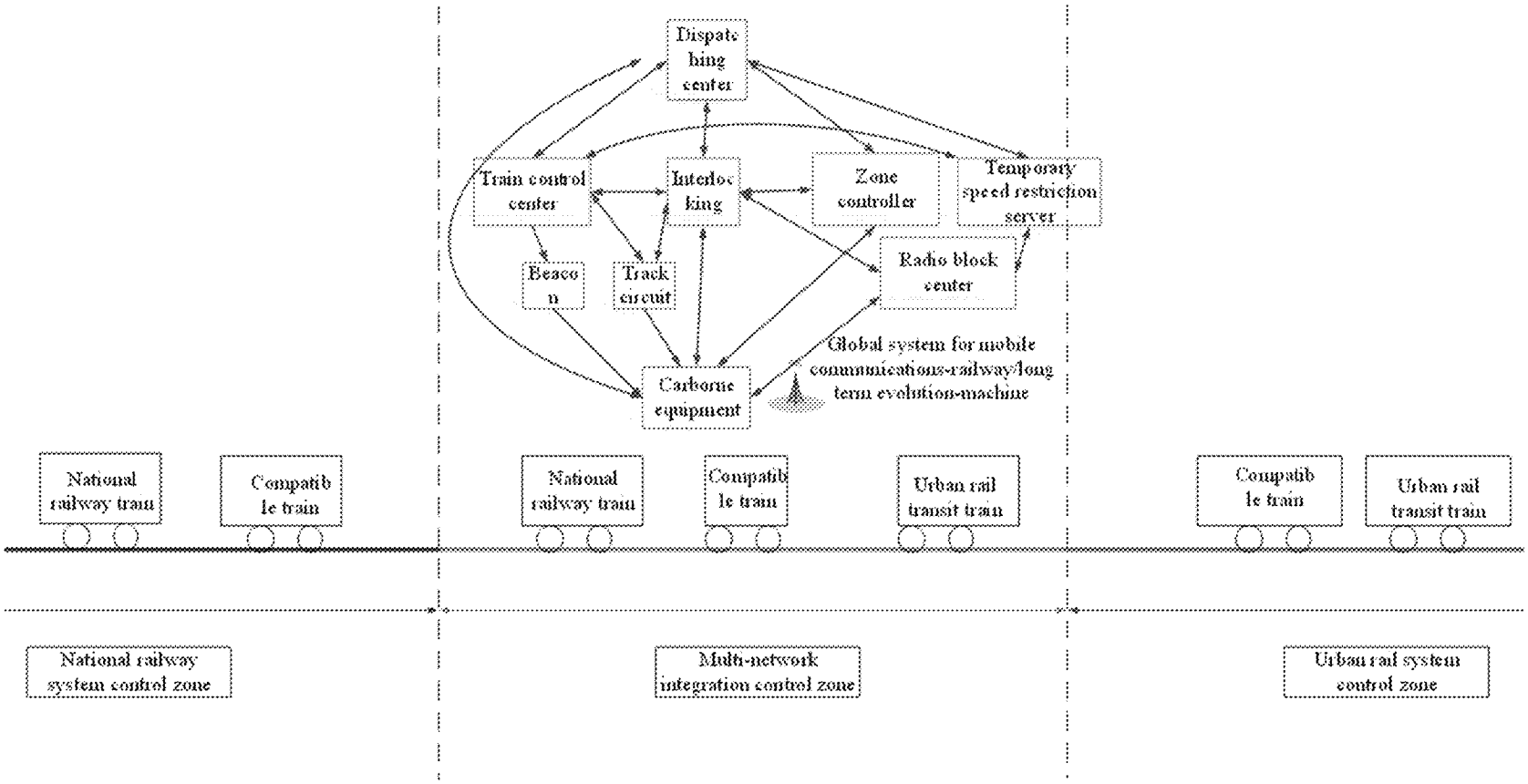
FIG. 2 is a schematic interconnection and interworking diagram of the rail transit signal system with multi-system integration according to the present disclosure.

As shown in FIG. 2, the compatible train, the national railway train, and the urban rail transit train may perform cross-line operation in a multi-network integration control zone, and the system manages the safety interval protection between various trains; and the compatible train using the universal secure carborne platform may also perform cross-line operation in a national railway system control zone and an urban rail system control zone.

The rail transit signal system with multi-network integration may be adapted as specific application solutions of different architectures according to different operation requirements of different line networks.

1. Multi-Network Integration Solution

For the line network that needs to support the cross-line interconnection and interworking operation of the national railway train and the urban rail transit train, the system architecture in FIG. 1 may be used.

Figure 3:
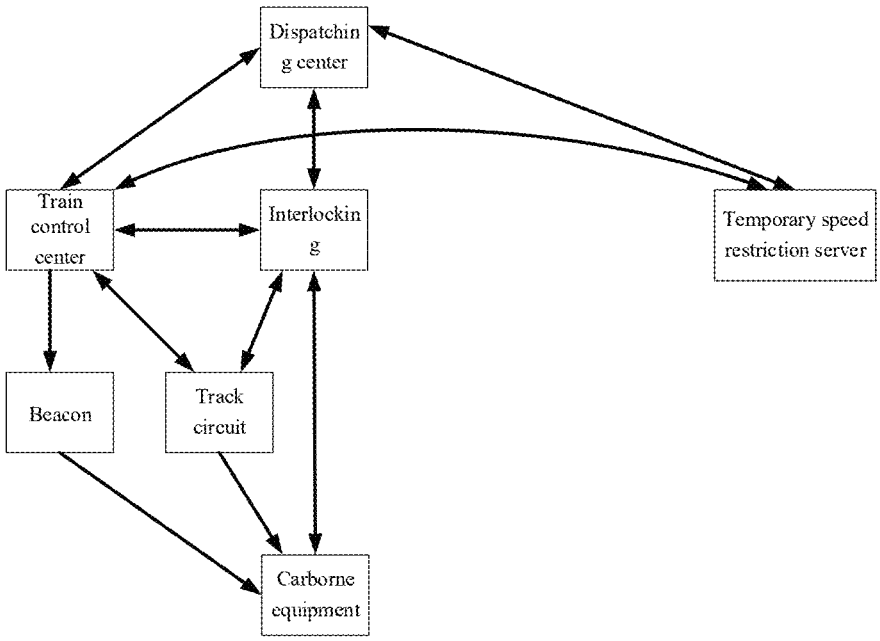
FIG. 3 is a schematic diagram of a first solution of an adaptable rail transit signal system according to the present disclosure.
Figure 4:
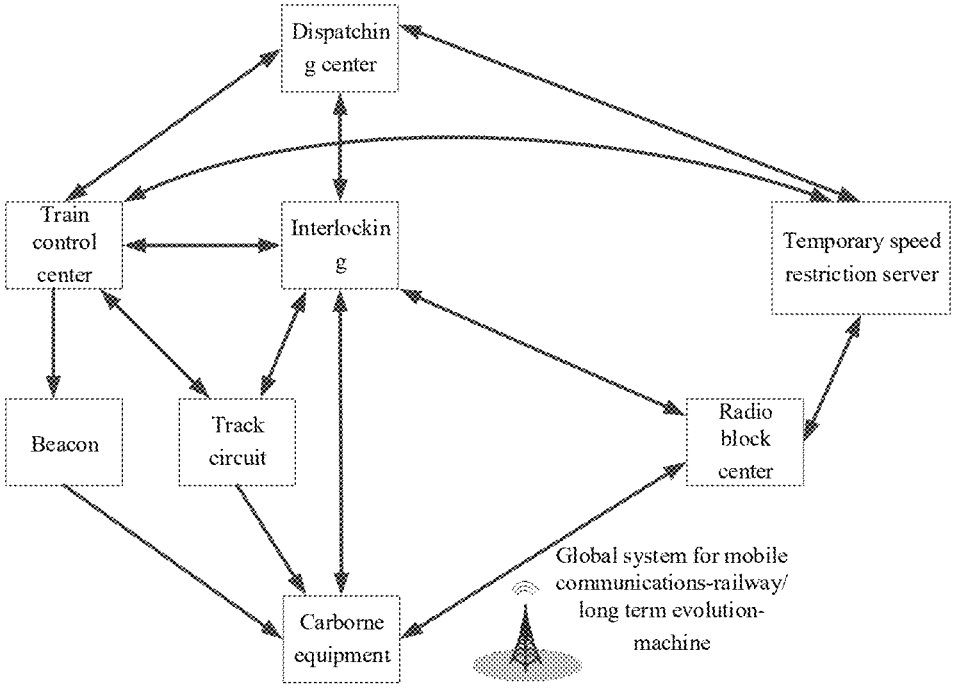
FIG. 4 is a schematic diagram of a second solution of the adaptable rail transit signal system according to the present disclosure.

2. Large operation interval solution for interconnection and interworking with national railway line network only For the line network that only needs to support the cross-line interconnection and interworking operation of the national railway train and requires the tracking operation interval to be no less than 4 minutes, the system architecture in FIG. 3 or FIG. 4 may be used.

3. Small operation interval solution for interconnection and interworking with national railway line network only For the line network that only needs to support the cross-line interconnection and interworking operation of the national railway train and requires the tracking operation interval to be less than 4 minutes, the system architecture in FIG. 1 may be used.

Figure 5:
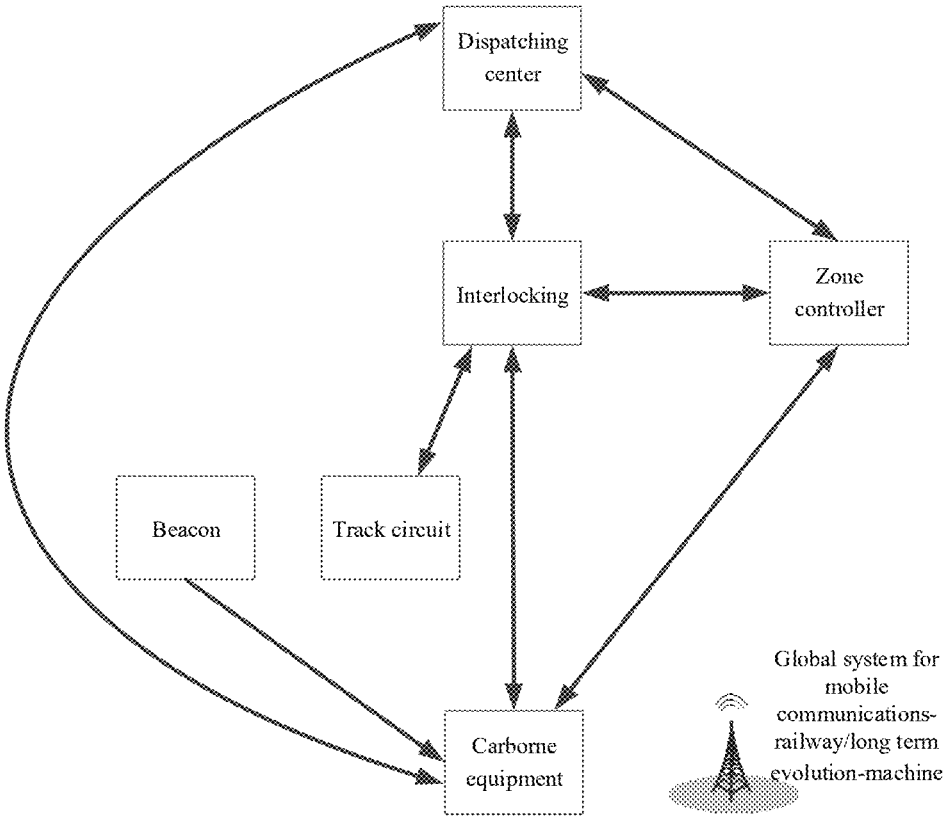
FIG. 5 is a schematic diagram of a third solution of the adaptable rail transit signal system according to the present disclosure.

4. Solution for interconnection and interworking with urban rail line network only For the line network that only needs to support the cross-line interconnection and interworking operation of the urban rail transit train, the system architecture in FIG. 5 may be used.

The above is only the specific implementation of the present disclosure, but the scope of protection of the present disclosure is not limited thereto. Any of those skilled in the art may easily think of various equivalent modifications or substitutions within the technical scope of the present disclosure, and these modifications or substitutions should be included in the scope of protection of the present disclosure. Therefore, the scope of protection of the present disclosure should be subject to the appended claims.

The invention claimed is:

1. A rail transit signal system with multi-network integration, comprising:

a wayside train control subsystem for simultaneously supporting tracking operation of a China train control system (CTCS)-based national railway train and a communication based train control (CBTC)-based urban rail transit train, the wayside train control subsystem being configured to control trains having a target speed, a line length, a station spacing, and an operation interval different from each other;

a compatible carborne subsystem for realizing cross-line operation of a national railway line network, an intercity railway network, a municipal railway network, and an urban rail transit network;

a networked intelligent dispatching subsystem for realizing intelligent dispatching management of rail transit line networks and cooperation of line network operation plans between different rail transit line networks;

an interlocking subsystem being respectively communicatively connected to and interacting with the wayside train control subsystem, the compatible carborne subsystem, and the networked intelligent dispatching subsystem; and a wireless train-ground communication subsystem for providing communication for the national railway train and the urban rail transit train, wherein the wayside train control subsystem includes a zone controller, a radio block center, a train control center, a temporary speed restriction server, a track circuit, and a beacon, the zone controller being connected to the compatible carborne subsystem, the networked intelligent dispatching subsystem, and the interlocking subsystem, the radio block center being connected to the temporary speed restriction server, the compatible carborne subsystem, and the interlocking subsystem, the train control center being connected to the track circuit, the beacon, the temporary speed restriction server, the networked intelligent dispatching subsystem, and the interlocking subsystem, the temporary speed restriction server, the track circuit, and the beacon being connected to the compatible carborne subsystem, and the track circuit being connected to the interlocking subsystem, wherein the wayside train control subsystem further includes a wayside switch machine and a signal machine connected to the train control center, the train control center being configured to generate a code sequence of the track circuit and a movement authority based on location information of the train and collected equipment status information of the wayside switch machine, the signal machine, and the track circuit, to control operation of trains of different systems and to realize safety interval protection between the trains, wherein the networked intelligent dispatching subsystem is configured to manage a fixed number of national railway trains and an unfixed number of urban rail transit trains by labeling train attributes, wherein the interlocking subsystem is configured to control the switch machine and the signal machine based on a route command, collect statuses of a platform door, an emergency stop button, and the track circuit, and lock and unlock of a route, wherein the interlocking subsystem includes interfaces with the zone controller, the wayside train control subsystem, and the compatible carborne subsystem.

2. The rail transit signal system with multi-network integration according to claim 1, wherein the compatible carborne subsystem includes a platform that is compatible with the CTCS-based national railway train and the CBTC-based urban rail transit train.

3. The rail transit signal system with multi-network integration according to claim 2, wherein in the national railway system line network, the compatible carborne subsystem includes a radio block center interface with national railway train control, is configured to control the train operation based on a movement authority provided by the radio block center, and when the radio block center is unavailable, is configured to control the train operation based on track circuit information and beacon information by reading a code sequence of a track circuit and the beacon information.

4. The rail transit signal system with multi-network integration according to claim 2, wherein in the urban rail system line network, the compatible carborne subsystem includes an interface with a zone controller and is configured to control the train operation based on a movement authority provided by the zone controller.

5. The rail transit signal system with multi-network integration according to claim 1, wherein the networked intelligent dispatching subsystem is configured to dynamically display a line equipment status and a train operation status in real time, to provide system operation modes corresponding to the line equipment status and the train operation status, to manage operation missions of the trains operating in the line networks according to a timetable, to manage cross-line network operation train plans between different rail transit line networks, to record operation data to generate a statistical report, and to provide playback and training functions.

6. The rail transit signal system with multi-network integration according to claim 1, wherein the wireless train-ground communication subsystem includes a communication module configured to provide a global system for mobile communications-railway (GSM-R) communication for the national railway train and a long term evolution-machine (LTE-M) communication for the urban rail transit train.

7. The rail transit signal system with multi-network integration according to claim 1, wherein the wireless train-ground communication subsystem includes interfaces for LTE to provide both an LTE-M service and a long term evolution-railway (LTE-R) service.

* * * * *